US009921519B2

(12) United States Patent
Sato

(10) Patent No.: US 9,921,519 B2
(45) Date of Patent: Mar. 20, 2018

(54) DEVELOPING DEVICE

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/269,046

(22) Filed: Sep. 19, 2016

(65) Prior Publication Data

US 2017/0003618 A1 Jan. 5, 2017

Related U.S. Application Data

(63) Continuation of application No. 14/755,997, filed on Jun. 30, 2015, now Pat. No. 9,448,509, which is a (Continued)

(30) Foreign Application Priority Data

Mar. 1, 2007 (JP) ..... 2007-051419

(51) Int. Cl.
*G03G 15/08* (2006.01)

(52) U.S. Cl.
CPC ..... *G03G 15/081* (2013.01); *G03G 15/0806* (2013.01); *G03G 15/0812* (2013.01); *G03G 15/0889* (2013.01); *G03G 2215/0827* (2013.01)

(58) Field of Classification Search
CPC ..... G03G 15/081; G03G 15/0887; G03G 15/0889; G03G 15/0891; G03G 15/0812; G03G 15/0806
See application file for complete search history.

(56) References Cited

U.S. PATENT DOCUMENTS 6,360,068 B1 3/2002 Kinoshita et al.
7,072,601 B2 7/2006 Kakitani et al.
(Continued)

FOREIGN PATENT DOCUMENTS

JP 06-161240 6/1994
JP 07-044008 A 2/1995
(Continued)

OTHER PUBLICATIONS

Office Action issued in corresponding Japanese Application No. 2007-051419, dated Oct. 25, 2011.
(Continued)

*Primary Examiner* — Hoang Ngo
(74) *Attorney, Agent, or Firm* — Banner & Witcoff, Ltd.

(57) ABSTRACT

A developing device and image forming apparatus are provided. The developing device includes a chassis; a developer carrying member; a thickness regulating member; a supply member; and a conveying member. In a state in which the developing device is attached to a main body an opening of the chassis faces upward; the thickness regulating member pressure-contacts the developer carrying member from below the developer carrying member; the conveying member is disposed below the developer carrying member; the supply member overlaps a portion of the conveying member in a horizontal direction; and a portion of the conveying member is disposed within a vertical projection plane between a pressure-contact position of the thickness regulating member to the developer carrying member, and a contact position of the supply member to the developer carrying member. The image forming apparatus includes a main body; a plurality of photosensitive members; and a plurality of developing devices.

11 Claims, 9 Drawing Sheets

Related U.S. Application Data continuation of application No. 13/614,289, filed on Sep. 13, 2012, now Pat. No. 9,091,959, which is a continuation of application No. 12/710,660, filed on Feb. 23, 2010, now Pat. No. 8,275,287, which is a continuation of application No. 12/040,133, filed on Feb. 29, 2008, now Pat. No. 7,693,451.

(56) References Cited

U.S. PATENT DOCUMENTS

| | | | | |
|---|---|---|---|---|
| 7,577,387 | B2 * | 8/2009 | Suzuki | G03G 15/0815 399/254 |
| 7,689,140 | B2 * | 3/2010 | Takesawa | G03G 15/0815 399/222 |
| 9,037,052 | B2 * | 5/2015 | Taguchi | G03G 15/0818 399/119 |
| 2002/0012552 | A1 | 1/2002 | Furukawa et al. | |
| 2005/0207793 | A1 | 9/2005 | Ikeda et al. | |
| 2006/0029422 | A1 * | 2/2006 | Shiraki | G03G 21/1857 399/111 |
| 2006/0029433 | A1 | 2/2006 | Saito et al. | |
| 2006/0216071 | A1 | 9/2006 | Yamada et al. | |
| 2007/0147889 | A1 | 6/2007 | Kamimura | |
| 2008/0247784 | A1 | 10/2008 | Kakuta et al. | |

FOREIGN PATENT DOCUMENTS

| | | | |
|---|---|---|---|
| JP | 07-044011 | A | 2/1995 |
| JP | 07-253716 | A | 10/1995 |
| JP | 08-104025 | A | 4/1996 |
| JP | 09-062088 | A | 3/1997 |
| JP | 09-311547 | A | 12/1997 |
| JP | 11-065160 | A | 3/1999 |
| JP | 2001-147585 | A | 5/2001 |
| JP | 2001-209225 | A | 8/2001 |
| JP | 2003-066722 | A | 3/2003 |
| JP | 2003-122121 | A | 4/2003 |
| JP | 2006-039424 | A | 2/2006 |
| JP | 04-107486 | B2 | 6/2008 |
| JP | 05-011586 | B2 | 8/2012 |

OTHER PUBLICATIONS

Notification of Reasons for Refusal issued in corresponding Japanese Application No. 2007-051419; dated Jun. 7, 2011.

* cited by examiner

DEVELOPING DEVICE

CROSS REFERENCE TO RELATED APPLICATION

The present application is a continuation application of prior U.S. application Ser. No. 14/755,997, filed Jun. 30, 2015, is a continuation application of prior U.S. application Ser. No. 13/614,289, filed Sep. 13, 2012, now U.S. Pat. No. 9,091,959, issued Jul. 28, 2015, which is a continuation application of prior U.S. application Ser. No. 12/710,660, filed Feb. 23, 2010, now U.S. Pat. No. 8,275,287, issued Sep. 25, 2012, which is a continuation of prior U.S. application Ser. No. 12/040,133, filed Feb. 29, 2008, now U.S. Pat. No. 7,693,451, issued Apr. 6, 2012, which claims priority from Japanese Patent Application No. 2007-051419, which was filed on Mar. 1, 2007, the disclosures of which are herein incorporated by reference in their entirety.

TECHNICAL FIELD

Devices and apparatuses consistent with the present invention relate to image formation, and more particularly, to an image forming apparatus such as a laser printer and to a developing device installed in the image forming apparatus.

BACKGROUND

In image forming apparatus such as a laser printer, a related art developing device having a toner carrying member such as a developing roller is detachably attached.

In addition to the toner carrying member, the related art developing device includes a layer forming member for forming a thin layer of a toner on the toner carrying member, a supply roller for supplying a toner to the toner carrying member, and a stirring member for stirring the toner (for example, see Patent Document 1).

In the related art developing device, the layer forming member is disposed on the lateral side of the toner carrying member, the supply roller is disposed below the toner carrying member, and the stirring member is disposed on the lateral side of the toner carrying member and the supply roller.

SUMMARY

In the developing device, the layer forming member is disposed on the lateral side of the toner carrying member, the supply roller is disposed below the toner carrying member, and the stirring member is on the lateral side of the toner carrying member and the supply roller. However, the related art developing device has a number of disadvantages. First, if the toner supplied from the supply roller to the developing roller leaks between the toner carrying member and the layer forming member, it is possible for the toner to leak from the developing device.

Moreover, since the toner carrying member, the layer forming member, and the stirring member are arranged in parallel in the horizontal direction, the related art developing device inevitably extends a long way in the horizontal direction and thus takes up a large amount of space in the horizontal direction. Moreover, since the related art developing device takes up a large amount of space in the horizontal direction, the image forming apparatus must also extend a long way in the horizontal direction, therefore taking up a large amount of space in the horizontal direction.

For example, in a related art tandem-type color laser printer, four related art developing devices are provided to correspond to colors of cyan, magenta, yellow, and black. Thus, the four related art developing devices take up a large amount of space in the horizontal direction, and the color laser printer thus extends in the horizontal direction and takes up a large amount of space in the horizontal direction. Thus, there is a problem that the color laser printer becomes very large.

Illustrative aspects of the present invention address the above disadvantages and other disadvantages not described above. However, the present invention is not required to overcome the disadvantages described above, and thus, an illustrative aspect of the present invention may not overcome any of the problems described above.

An aspect of the present invention is to provide a developing device, which can allow a developer carrying member to efficiently carry a sufficient amount of a developer while preventing leakage of the developer and which can enable miniaturization of the developing device, and an image forming apparatus having the developing device.

According to a first illustrative aspect of the present invention, there is provided a developing device that is attachable to a main body, the developing device including a chassis having an opening; a developer carrying member for carrying a developer; a thickness regulating member that pressure-contacts the surface of the developer carrying member and that forms a thin layer of the developer on the surface of the developer carrying member; a supply member that contacts the developer carrying member and that supplies the developer to the developer carrying member; and a conveying member that conveys the developer so that the developer is supplied to the supply member. The developer carrying member, the thickness regulating member, the supply member, and the conveying member are provided within the chassis. In a state in which the developing device is attached to the main body the opening of the chassis faces upward; the upper portion of the developer carrying member is exposed from the opening; the thickness regulating member pressure-contacts the surface of the developer carrying member from the down side; the conveying member is disposed below the developer carrying member and conveys the developer in the longitudinal direction of the conveying member; the supply member overlaps with at least a portion of the conveying member in a horizontal direction; and at least a portion of the conveying member is disposed within a vertical projection plane between a pressure-contact position of the thickness regulating member to the developer carrying member, and a contact position of the supply member to the developer carrying member.

In the first aspect of the invention, the opening of the chassis faces upward, and the upper portion of the developer carrying member is exposed from the opening. The thickness regulating member and the conveying member are disposed below the developer carrying member, and the supply member is disposed so as to overlap with at least a portion of the conveying member in the horizontal direction. That is, the supply member is disposed on the lateral side of the conveying member.

For this reason, the developer is first conveyed by the conveying member to the supply member disposed on the lateral side of the conveying member. Thereafter, the developer is supplied from the supply member to the developer carrying member disposed above the supply member. The developer is carried as a thin layer on the surface of the developer carrying member with the thickness regulating member. The developer carried on the surface of the developer carrying member is used in developing processes when opposed to the opening.

The developer that was not supplied from the supply member to the developer carrying member and the developer that was removed by the thickness regulating member from the surface of the developer carrying member fall off from the developer carrying member.

Meanwhile, at least a portion of the conveying member is disposed within a vertical projection plane between a pressure-contact position of the thickness regulating member to the developer carrying member and a contact position of the supply member to the developer carrying member. For this reason, the developer falling off from the developer carrying member is again conveyed by the conveying member to the supply member and thereafter is used in developing processes.

As a result, the developer carrying member can efficiently carry a sufficient amount of a developer. Since the developer that is not carried on the developer carrying member falls down within the chassis, it is possible to prevent leakage of the developer from the developing device. Even when the developer leaks between the thickness regulating member and the developer carrying member, the developer falls down without facing toward the opening. It is possible to efficiently prevent leakage the developer from the chassis.

Since the thickness regulating member and the conveying member are disposed below the developer carrying member, and the supply member is disposed on the lateral side of the thickness regulating member and the conveying member, it is possible to decrease the horizontal length of the developing device. For this reason, it is possible to enable miniaturization of the developing device.

Since the developer is conveyed by the conveying member in the longitudinal direction of the conveying member, the developer can circulate appropriately (in a convective manner) and can be properly supplied to the developer carrying member.

According to a second illustrative aspect of the present invention, there is provided an image forming apparatus. The image forming apparatus comprises a main body; a plurality of photosensitive members on which electrostatic latent images are formed; and a plurality of developing devices which are provided to correspond to the plurality of photosensitive members and develop the electrostatic latent images to form developer images.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

1. Image Forming Apparatus

Figure 1:
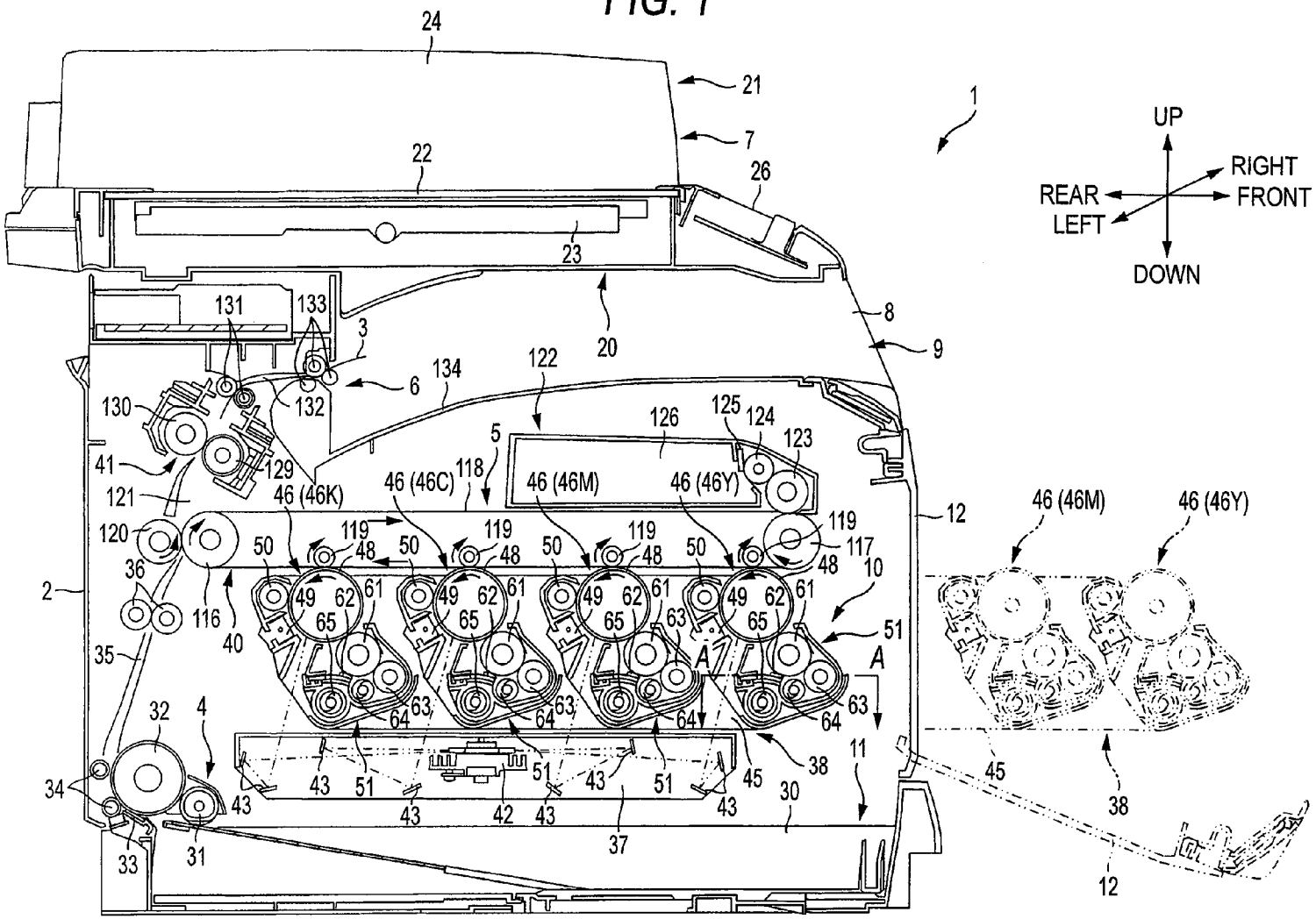
FIG. 1 is a side sectional view illustrating an image forming apparatus according to an exemplary embodiment of the present invention.
Figure 2:
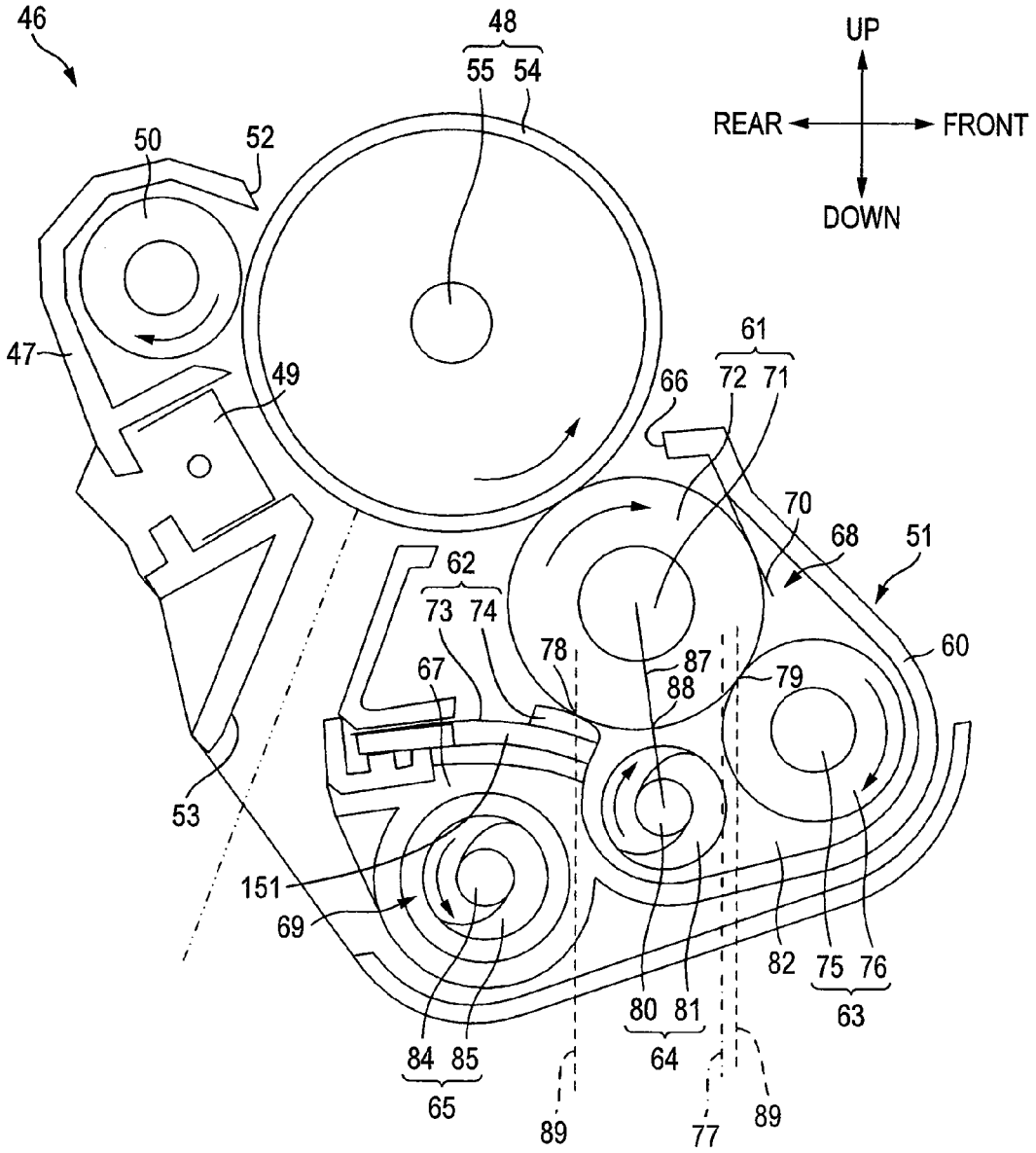
FIG. 2 is an enlarged side sectional view illustrating a part of the image forming apparatus of FIG. 1.

FIG. 1 is a side sectional view illustrating an example of an image forming apparatus according to an exemplary embodiment of the invention. FIG. 1 shows a color laser printer as an example of the image forming apparatus. However, the present inventive concept is not limited to a color laser printer and is applicable to other types of image forming apparatuses. FIG. 2 is an enlarged side sectional view illustrating a part of the image forming apparatus of FIG. 1.

The color laser printer 1 is a horizontal, tandem-type color laser printer in which a plurality of process units 46 is arranged in parallel in the horizontal direction.

As shown in FIG. 1, the color laser printer 1 is configured as a multi function device, which includes a main casing 2 as an example of the main body and a flat-bed (FB) unit 7 that is disposed above the main casing 2, for reading image information of a document.

The color laser printer 1 includes, within the main casing 2, a sheet feeding portion 4 for feeding a sheet 3, an image forming portion 5 for forming images on the fed sheet 3, and a sheet discharging portion 6 for discharging the sheet 3 having images formed thereon.

In the following description, the right side of FIG. 1 will be referred to as a front side (front surface side), and the left side of FIG. 1 will be referred to as a rear side (rear surface side). In addition, the front side in the thickness direction of the sheet in FIG. 1 will be referred to as a left side, and the rear side in the thickness direction of the sheet in FIG. 1 will be referred to as a right side. Incidentally, the left-right direction is the same as the width direction.

The process unit 46 and a developing unit 51 can be attached to and detached from the main casing 2. The directions of the process unit 46 and the developing unit 51 will be described based on the directions in a state in which they are attached to the main casing 2.

(1) Main Casing

Figure 3:
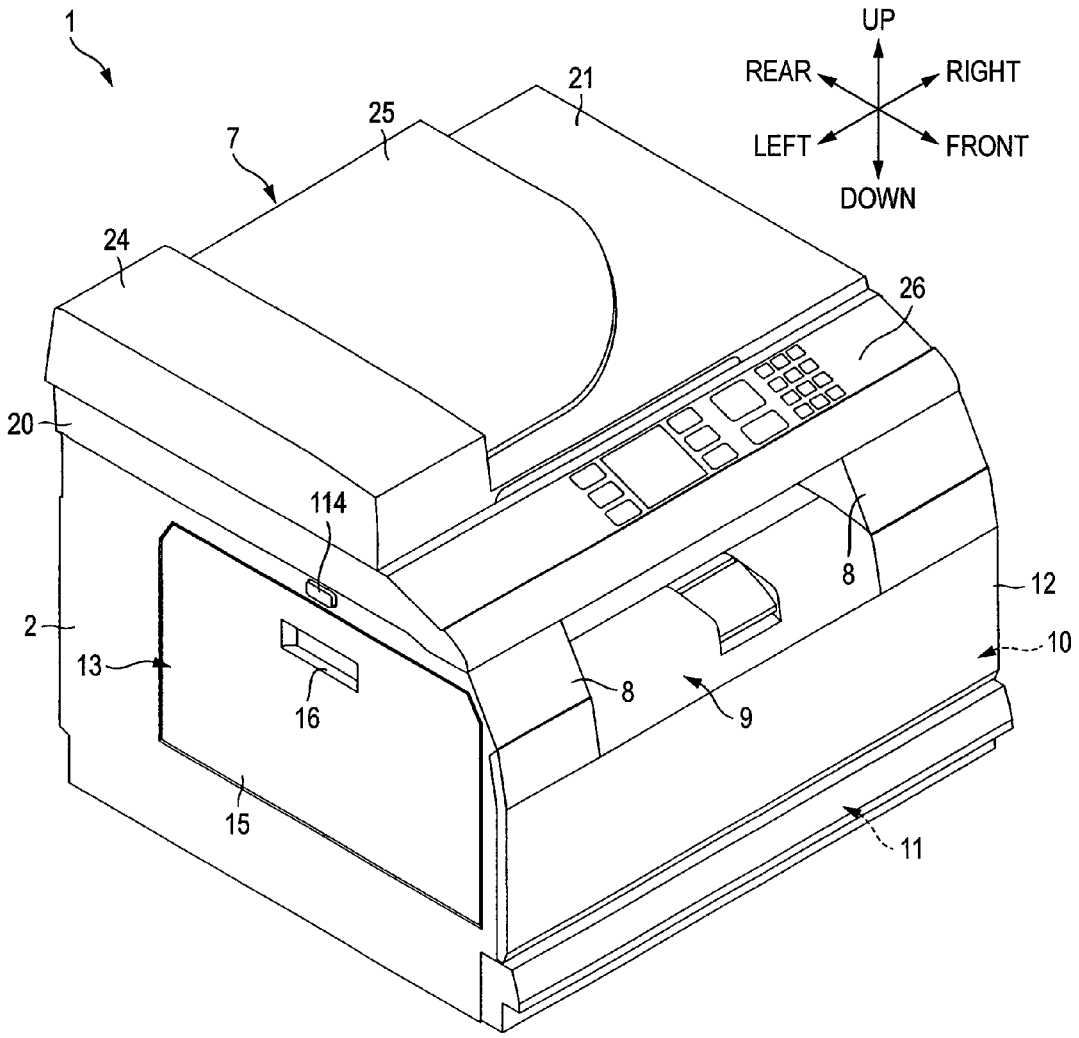
FIG. 3 is a left perspective view of the image forming apparatus of FIG. 1 showing a holder frame in a reception position.
Figure 4:
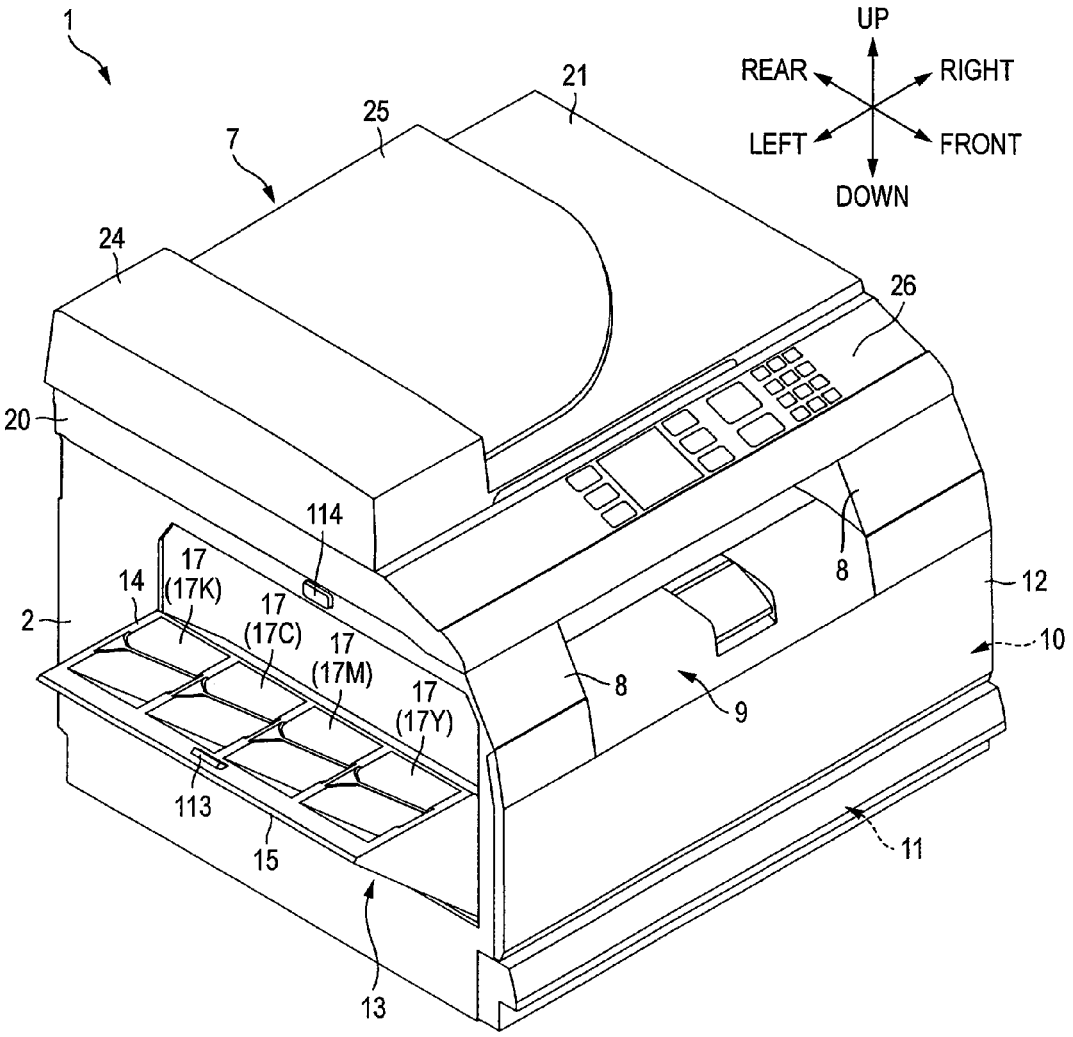
FIG. 4 is a left perspective view of the image forming apparatus of FIG. 1 showing the holder frame in an attachment and detachment position.

FIG. 3 is a left perspective view of the image forming apparatus of FIG. 1 in which a holder frame is in a reception position. FIG. 4 is a left perspective view of the image forming apparatus of FIG. 1 in which the holder frame is in an attachment and detachment position.

As shown in FIG. 3, the main casing 2 is formed in a box-like shape. On a top wall of the main casing 2, a connecting portion 8 is provided substantially having a U shape in plan view. The connecting portion 8 is disposed at both ends and the rear end of the top wall of the main casing 2 so that the front portion thereof is open. The FB unit 7 is provided on the connecting portion 8.

A space surrounded by the top surface of the main casing 2, the connecting portion 8, and the bottom surface of the FB unit 7 is configured as an in-chassis sheet discharging portion 9 in which the sheet 3 is discharged.

Within the main casing 2, as shown in FIG. 1, a process receiving portion 10 is provided in which a process portion 38 is disposed.

On a front wall of the main casing 2 opposed to the process receiving portion 10, a front cover 12 is provided for opening and closing the process receiving portion 10. The lower end of the front cover 12 is pivotably provided to the main casing 2 via a hinge (not shown). When the front cover 12 is closed, the process receiving portion 10 closes. When the front cover 12 is open, the process receiving portion 10 opens as shown by an imaginary line in FIG. 1, thus allowing a drawer 45 that receives a plurality of process units 46 to be attached or detached.

On a left side wall of the main casing 2 opposed to the process receiving portion 10, as shown in FIGS. 3 and 4, a cartridge holder 13 that detachably receives plural (four) toner cartridges 90 (see FIG. 6) is provided.

The cartridge holder 13 includes a holder frame 14 and a side cover 15 provided at the left side of the holder frame 14.

The holder frame 14 is partitioned into four cartridge receiving portions 17 along the front-rear direction. The cartridge receiving portions 17 are provided to correspond to toners of each color. That is, the cartridge receiving portions 17 comprise four portions: a yellow cartridge receiving portion 17Y, a magenta cartridge receiving portion 17M, a cyan cartridge receiving portion 17C, and a black cartridge receiving portion 17K. These four cartridge receiving portions 17 are arranged in parallel in this order with gaps therebetween in a direction from the front area to the rear area. In each cartridge receiving portion 17, the toner cartridge 90 corresponding to each color is received.

On the upper end of the holder frame 14, an engaging protrusion 113 (described later) is provided at the center in the front-rear direction.

The lower end of the holder frame 14 is pivotably provided to the main casing 2 via a hinge (not shown).

The side cover 15 covers the holder frame 14 from the left side, and a grip 16 is formed on the upper portion at the center in the front-rear direction.

When the grip 16 is gripped to pull the side cover 15 toward the left side, as shown in FIG. 4, the holder frame 14 is pivoted leftward about the lower end and is disposed at an attachment and detachment position at which the upper end is exposed leftward from the main casing 2. Thus, four cartridge receiving portions 17 are exposed from the main casing 2.

On the other hand, when the grip 16 is gripped to push the side cover 15 toward the right side, as shown in FIG. 3, the holder frame 14 is pivoted rightward about the lower end and is disposed at a reception position at which the upper end is received in the main casing 2. Thus, four cartridge receiving portions 17 are received in the main casing 2.

Within the main casing 2, as shown in FIG. 1, a tray receiving portion 11 that receives a sheet feeding tray is provided below the process receiving portion 10. A front wall of the main casing 2 opposed to the tray receiving portion 11 is open.

(2) Flat-Bed (FB) Unit

As shown in FIG. 3, the FB unit 7 includes a document platen 20 and a document pressing cover 21 that is supported by the document platen 20 in an openable manner.

The document platen 20 has a rectangular, thick plate-like shape in plan view. The document platen 20 is supported by the connecting portion 8, and as shown in FIG. 1, a glass surface 22 on which a document is placed is buried in the top surface. In the document plate 20, a CCD sensor 23 for reading a document and a scan drive motor (not shown) for scanning the document with the CCD sensor 23 opposed to the glass surface 22 are provided.

As shown in FIG. 3, the document pressing cover 21 has a rectangular thin plate-like shape in plan view. The rear end is pivotably supported by the rear end of the document platen 20 via a hinge (not shown). The document pressing cover 21 is provided with an automatic document feeder (ADF) 24 for automatically reading a document at the left end of an upper portion thereof. A standby document tray 25 that extends rightward is provided in the ADF 24.

In the FB unit 7, an operation panel 26 having operation keys and a light emitting diode (LED) display portion is buried in an area located closer to the front end than the glass surface 22 of the document platen 20.

In the FB unit 7, during manual document reading operations, the front end of the document pressing cover is first moved upward to place a document on the glass surface 22. Thereafter, the front end of the document pressing cover 21 is moved downward and the operation keys on the operation panel 26 are operated. Then, the CCD sensor 23 is driven by the scan drive motor and scans the document placed on the glass surface 22 in a direction from the left side to the right side in an opposing relationship with the document. Accordingly, image information of the document is read.

During automatic document reading operations by the ADF 24, when a document is set on the standby document tray 25, a document detecting sensor (not shown) detects the setting of document and the CCD sensor 23 is fixed at an automatic document reading position (not shown). Thereafter, when the operation keys are operated on the operation panel 26, the ADF 24 is driven and the document is moved leftward and is inserted into the ADF 24. The image information of the document is read by the CCD sensor 23 in a state that the document is opposed to the CCD sensor 23. Thereafter, the document is conveyed rightward from the ADF 24 and discharged onto the upper surface of the document pressing cover 21.

The image forming portion 5 (see FIG. 1) creates image data based on the image information of the document read by the CCD sensor 23 and forms images on the sheet 3, which will be described later.

(3) Sheet Feeding Portion

As shown in FIG. 1, the sheet feeding portion 4 is provided below the main casing 2. The sheet feeding portion 4 includes a sheet feeding tray 30 for receiving the sheet 3, a feed roller 31 provided above the rear end of the sheet feeding tray 30, and a supply roller 32 and a separation pad 33 that are provided at the rear side of the feed roller 31 in an opposing relationship with each other. The sheet feeding portion 4 also includes two auxiliary rollers 34 disposed above the separation pad 33 in an opposing relationship with the separation roller 32, a sheet feeding path 35 that extends slightly upward from the opposing portion of the separation roller 32 and the upper one of the auxiliary rollers 34, and a pair of conveying rollers 36 provided in the midway of the sheet feeding path 35.

The sheet feeding tray 30 is attached to and detached from the tray receiving portion 11 of the main casing 2 in a manner slidable in a direction from the front side to the rear side. When the sheet feeding tray 30 is received in the tray receiving portion 11, an open port in the front wall of the main casing 2 opposed to the tray receiving portion 11 is closed by the front end of the sheet feeding tray 30.

Within the sheet feeding tray 30, the sheet 3 is stacked, and the uppermost sheet 3 is supplied to the opposing portion of the separation roller 32 and the separation pad 33 with the rotation of the feed roller 31 and is processed on a one-by-one basis. Thereafter, the sheet 3 is fed from the separation roller 32 to the sheet feeding path 35 while being guided by the auxiliary rollers 34. Thereafter, the sheet 3 is conveyed to the conveying roller 36 and conveyed to a secondary transfer position (described later) between a secondary transfer roller 120 and an intermediate transfer belt 118.

(4) Image Forming Portion

The image forming portion 5 includes a scanner unit 37, a process portion 38, a transfer portion 40, and a fixing portion 41.

(4-1) Scanner Unit

The scanner unit 37 is disposed between the process receiving portion 10 and the tray receiving portion 11 in the main casing 2. Within the scanner unit 37, optical members including a light source (not shown), a polygon mirror 42, and a reflective mirror 43 are disposed.

Laser beams emitted from the light source, based on the image data, are deflected and scanned by the polygon mirror 42 and reflected from the reflective mirror 43, and thereafter, as shown by the chained line, are irradiated onto the surface of a photosensitive drum 48 (described later) as an example of a photosensitive member of each of the process units 46.

(4-2) Process Portion

The process portion 38 includes the drawer 45 and a plurality of process units 46 received in the drawer 45. In this exemplary embodiment the process portion 38 includes four process units 46.

The four process units 46 are attached to the drawer 45 in a separately detachable manner. The drawer 45 is attached to and detached from the process receiving portion 10 by the opening of the front cover 12 in a manner slidable in a direction from the front side to the rear side, as shown by the imaginary line. Thus, a plurality of the process units 46 can be attached to and detached from the process receiving portion 10 in a bundle.

The process units 46 are provided to correspond to toners of each color.

That is, the process units 46 are composed of four units: a yellow process unit 46Y, a magenta process unit 46M, a cyan process unit 46C, and a black process unit 46K. These four process units 46 are arranged in parallel in this order with gaps therebetween in a direction from the front area to the rear area.

When the front cover 12 is opened to draw the drawer 45 out from the process receiving portion 10, the process units 46 are exposed from the main casing 2. At this time, by separately attaching or detaching the process units 46 to or from the drawer 45, it is possible to replace each of the process units 46.

(a) Process Unit

As shown in FIG. 2, each of the process units 46 includes a process casing 47 and includes, within the process casing 47, a photosensitive drum 48, a scorotron charger 49, a cleaning roller 50, and a developing unit 51 as an example of the developing device.

The process casing 47 is formed in a substantially rectangular, box-like shape in sectional view, extending from the lower front side to the upper rear side. A transfer opening 52 is formed in the upper portion of the process casing 47, and an input path 53 opposed to the transfer opening 52 is formed in the lower portion of the process casing 47.

The photosensitive drum 48 includes a drum body 54 and a drum shaft 55. The drum body 54 is formed in a hollow cylindrical shape, and the outermost layer is formed of a positively charged photosensitive layer such as polycarbonate. The drum shaft 55 is provided at the center of the rotation shaft of the drum body 54 and extends in the axial direction of the drum body 54.

The drum shaft 55 is non-rotatably supported by both side walls of the process casing 47 that are disposed opposite each other with a gap in the width direction. The drum body 54 is rotatable about the drum shaft 55 with its upper half portion exposed upward from the transfer opening 52. The drum body 54 is grounded and during image forming operations, rotates in the counter-clockwise direction when seen from the left side by a driving force of a motor (not shown) provided in the main casing 2.

The scorotron charger 49 is supported by the rear wall of the process casing 47 above the input path 53 and is disposed at the lower rear side of the photosensitive drum 48 in an opposing relationship with the photosensitive drum 48 with a gap therebetween. The scorotron charger 49 is a positively charging scorotron charger which, during image forming operations, is applied with a high voltage from a high-voltage substrate (not shown) provided in the main casing 2 to generate a corona discharge.

The cleaning roller 50 is supported by the rear wall of the process casing 47 above the scorotron charger 49 and is disposed at the rear side of the photosensitive drum in an opposing contact relationship with the photosensitive drum 48. During image forming operations, the cleaning roller 50 rotates in the clockwise direction (the same as the rotation direction of the photosensitive drum 48 at the contact portion of the cleaning roller 50 and the photosensitive drum 48), when seen from the left side, by a driving force of the motor, and is applied with a cleaning bias from the high-voltage substrate.

(b) Developing Unit

Figure 5:
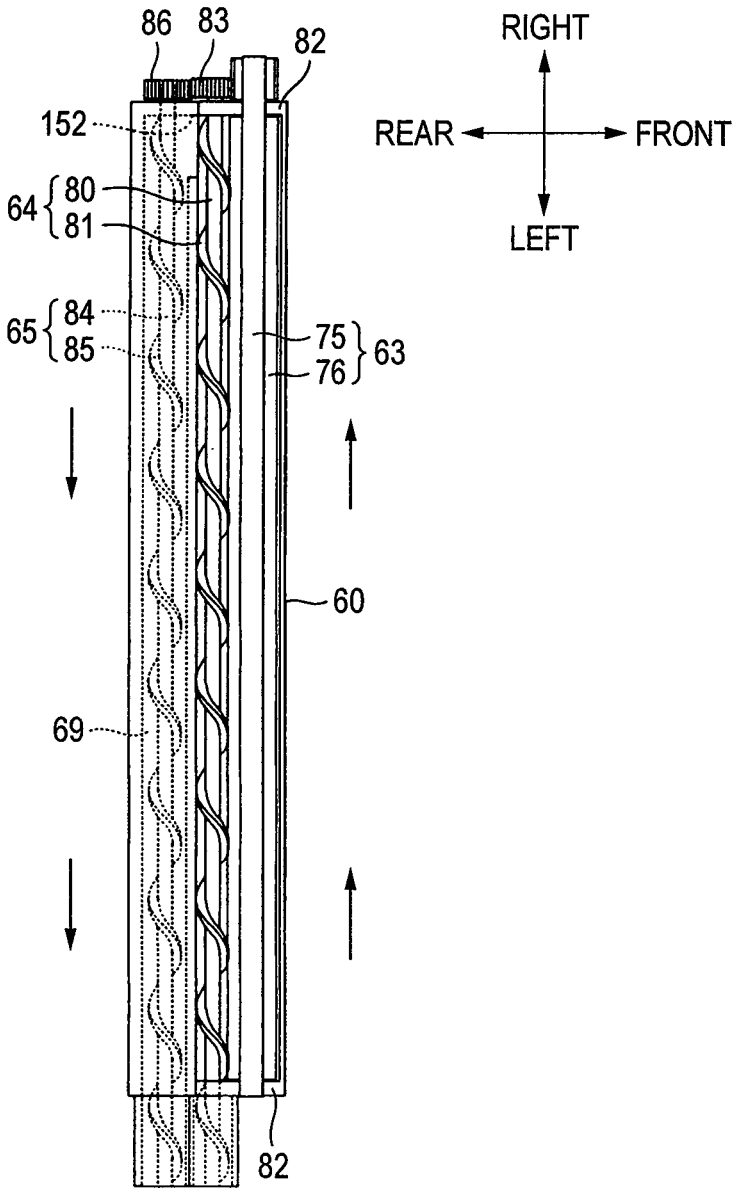
FIG. 5 is a top sectional view of a developing unit of the image forming apparatus of FIG. 1 according to an exemplary embodiment of the present invention.

FIG. 5 is a top sectional view of the developing unit of the color laser printer shown in FIG. 1.

As shown in FIG. 1, four developing units 51 are provided to correspond to four photosensitive drums 48. As shown in FIG. 2, each of the developing units 51 includes a developing casing 60 and includes, within the developing casing 60, a developing roller 61 as an example of the developer carrying member, a thickness regulating blade 62 as an example of the thickness regulating member, a supply roller 63 as an example of the supply member, a conveying auger 64 as an example of the conveying member, and a return auger 65.

(b-1) Developing Casing

The developing casing 60 is formed in a substantially trapezoidal, box-like shape in sectional view, with its width decreasing in a direction from the lower front side to the upper rear side. A developing opening 66 as an example of the opening that is open upward is formed in the upper portion of the developing casing 60.

On the lower portion of the developing casing 60, a partition wall 67 is formed that covers a corner portion at the lower rear side in the width direction. The inner space of the developing casing 60 is vertically partitioned by the partition wall 67 into an upper space that forms a developing chamber 68 and a lower space that forms a toner return chamber 69. The developing chamber 68 is formed in a substantially rectangular shape in sectional view, and the toner return chamber 69 is formed in a substantially circular shape in sectional view. The developing chamber 68 and the toner return chamber 69 are communicated with each other via a communication port 152 (see FIG. 5) formed in the right end of the partition wall 67.

On the inner front wall of the developing casing 60, a developer seal 70 is provided below the developer opening 66, extending in the up-down direction. The developer seal 70 is formed of a film, and the upper end is supported by the inner front wall of the developing casing 60 and the lower end makes sliding contact with the developing roller 61. The developer seal 70 closes a space between the front wall of the developing casing 60 and the developing roller 61.

(b-2) Developing Roller

The developing roller 61 is disposed at the central portion of the developing chamber 68 so that the upper portion of the developing roller 61 is exposed from the developing opening 66. Specifically, the developing roller 61 is disposed below the photosensitive drum 48 in an opposing contact relationship with the photosensitive drum 48 via the developing opening 66. Within the developing chamber 68, the developing roller is disposed between the inner front wall of the developing casing 60 and the partition wall 67 at the center in the front-rear direction.

The developing roller 61 includes a developing roller shaft 71 and a rubber roller 72 that covers the developing roller shaft 71. The developing roller shaft is made of metallic materials and is rotatably supported by both side walls 82 (see FIG. 5) of the developing casing 60 that are disposed opposite each other with a gap in the width direction. The rubber roller 72 is formed of conductive rubber and is provided around the developing roller shaft 71.

During image forming operations, the developing roller rotates in the clockwise direction (opposite to the rotation direction of the photosensitive drum 48), when seen from the left side, by a driving force of the motor. In this rotation, the developing roller 61 rotates such that a pressure-contact position 78 of the thickness regulating blade 62 to the developing roller is on the upstream side of an exposure position of the developing roller 61 from the developing opening 66 and that a contact position 79 of the supply roller 63 to the developing roller 61 is on the downstream side of the exposure position. The developing roller 61 is applied with a developing bias from the high-voltage substrate during image forming operations.

(b-3) Thickness Regulating Blade

The thickness regulating blade 62 is disposed below the developing roller 61 in the developing chamber 68. The thickness regulating blade 62 includes a blade body 73 and a pressure-contact portion 74.

The blade body 73 is formed of a spring steel plate having a substantially rectangular shape. The blade body 73 extends in the front-rear direction along the partition wall 67, and the rear end is supported by the rear wall of the developing casing 60 and the front end is disposed between the developing roller 61 and the partition wall 67.

The pressure-contact portion 74 is provided on the upper surface of the front end of the blade body 73. The pressure-contact portion 74 is formed of insulating silicon rubber having a substantially rectangular shape in sectional view. The pressure-contact portion 74 is disposed between the developing roller 61 and the partition wall 67 in an opposing relationship with the rubber roller 72 in the width direction.

In the thickness regulating blade 62, the pressure-contact portion 74 pressure-contacts the surface of the rubber roller 72 from the down side by the elastic force of the blade body 73.

A sponge seal 151 is provided between the partition wall and the blade body 73. The sponge seal 151 is stacked on the partition wall 67 along the partition wall 67. The blade body 73 is disposed on the sponge seal 151.

A space between the partition wall 67 and the developing roller 61 is closed by the thickness regulating blade 62 and the sponge seal 151. Thus, the inner front portion of the developing chamber 68 is partitioned as a closed space having a substantially triangular shape in sectional view with its width decreasing toward the front side, in which the rear side of the inner front portion is closed by the developing seal 70, the developing roller 61, the thickness regulating blade 62, and the sponge seal 151.

(b-4) Supply Roller

The supply roller 63 is disposed at the lower front side of the developing roller 61 and at the upper front side of the conveying auger 64, in the inner front portion of the developing chamber 68. Specifically, the supply roller 63 is disposed such that in the front-rear direction (horizontal direction), the upper portion of the supply roller 63 overlaps with the lower portion of the developing roller 61 and that the lower portion of the supply roller 63 overlaps with the upper portion of the conveying auger 64. In addition, the supply roller is disposed such that in the up-down direction (vertical direction), a tangential line 77 extending in the vertical direction at the rearmost end of the supply roller 63 passes through the front portion of the developing roller 61 and the front most end of the conveying auger 64.

The supply roller 63 includes a supply roller shaft 75 and a sponge roller 76 that covers the supply roller shaft 75. The supply roller shaft 75 is made of metallic materials and is rotatably supported by both side walls 82 of the developing casing 60. The sponge roller 76 is formed of a conductive foamed material and is provided around the supply roller shaft 75. The sponge roller 76 and the rubber roller 72 are in contact in a mutually pressurized state.

During image forming operations, the supply roller 63 rotates in the clockwise direction (the same as the rotation direction of the developing roller 61), when seen from the left side, by a driving force of the motor.

(b-5) Conveying Auger

The conveying auger 64 is disposed below the developing roller 61 and at the lower rear side of the supply roller 63 in the inner front portion of the developing chamber 68. Specifically, the conveying auger 64 is disposed within a projection plane (shown by a dotted line 89) in the up-down direction (vertical direction) between the pressure-contact position 78 of the pressure-contact portion 74 to the rubber roller 72 and the contact position 79 of the sponge roller 76 to the rubber roller 72.

Specifically, an intersection 88 of the surface of the rubber roller 72 and a segment 87 that connects the central axis line of the developing roller shaft 71 and the central axis line of a conveying auger shaft 80 (described later) is on the downstream side of the contact position 79 in the rotation direction of the developing roller 61. The pressure-contact position 78 is on the downstream side of the intersection 88 in the rotation direction of the developing roller 61.

The conveying auger 64 is disposed at a distance from the developing roller 61 and the supply roller 63.

As shown in FIG. 5, the conveying auger 64 includes a conveying auger shaft 80 and a conveying screw 81. The conveying auger shaft 80 is rotatably supported by both side walls 82 of the developing casing 60. The conveying screw 81 is continuously provided in the axial direction around the conveying auger shaft 80. The conveying screw 81 is formed in a spiral shape so that toner can be conveyed in the width direction from the left side to the right side.

The conveying auger 64 is provided to protrude from the side wall 82 on one (left) side in the width direction of the developing casing 60 toward the outside (the left side).

During image forming operations, the driving force of the motor is transmitted to a conveying auger gear 83 connected at the right end of the conveying auger shaft 80, and the conveying auger 64 rotates in the clockwise direction (the same as the rotation direction of the supply roller 63) when seen from the left side.

(b-6) Return Auger

As shown in FIG. 2, the return auger 65 is received in the toner return chamber 69 below the thickness regulating blade 62. The return auger 65 is disposed at the lower rear side of the conveying auger 64 in an opposing relationship with the conveying auger 64 with the partition wall 67 disposed therebetween.

As shown in FIG. 5, the return auger 65 includes a return auger shaft 84 and a return screw 85. The return auger shaft 84 is rotatably supported by both side walls 82 of the developing casing 60. The return screw 85 is continuously provided in the axial direction around the return auger shaft 84. The return screw 85 is formed in a spiral shape so that toner can be conveyed in a direction from the right side to the left side.

The return auger 65 is provided to protrude from the left side wall 82 of the developing casing 60 toward the left side.

During image forming operations, the driving force of the motor is transmitted to a return auger gear 86 connected at the right end of the return auger shaft 84, and the return auger 65 rotates in the counter-clockwise direction (opposite to the rotation direction of the conveying auger 64) when seen from the left side.

(c) Toner Cartridge

Figure 6:
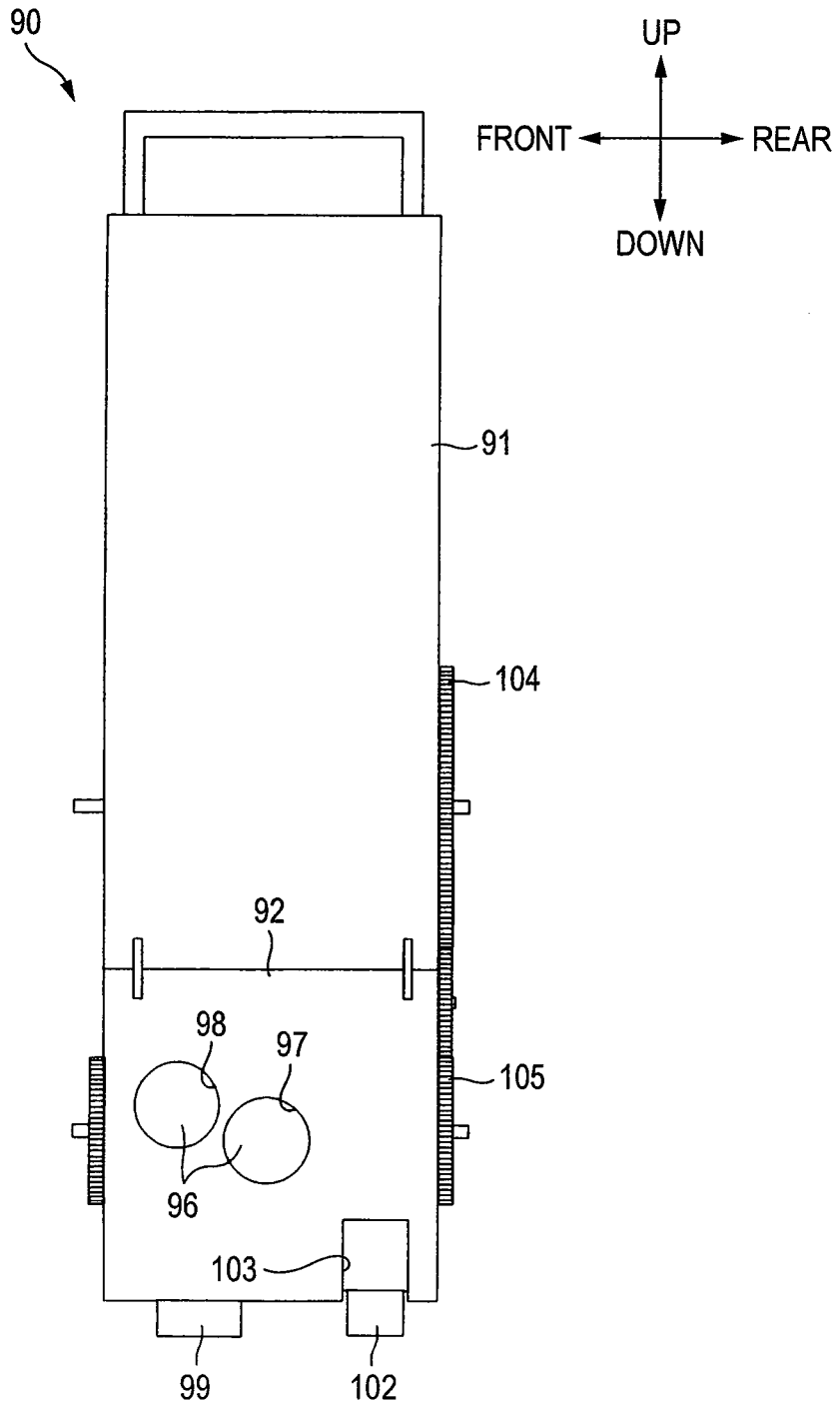
FIG. 6 is a right sectional view of a toner cartridge of the image forming apparatus of FIG. 1.
Figure 7:
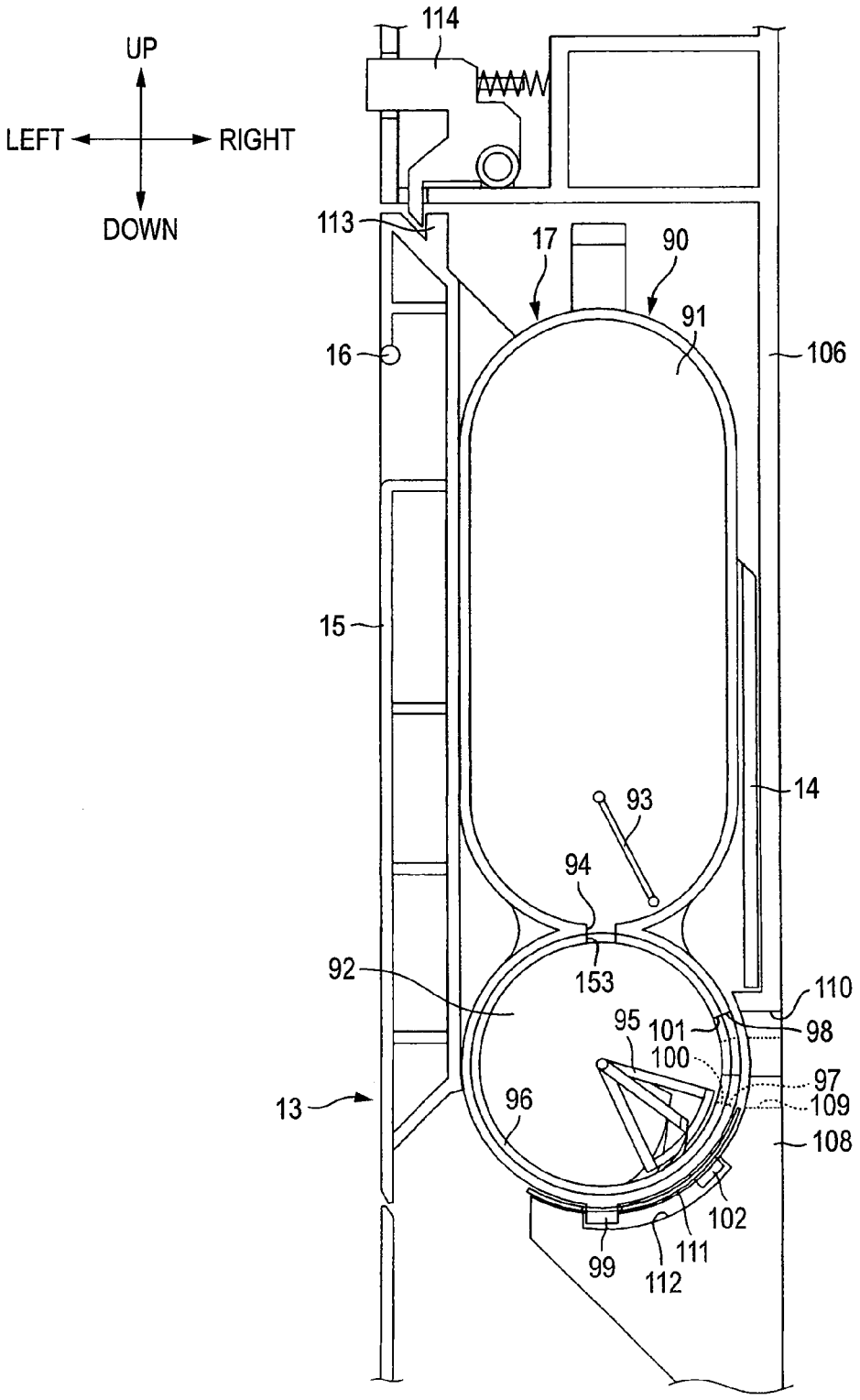
FIG. 7 is a front sectional view of a cartridge holder of the image forming apparatus of FIG. 1 with the holder frame in the reception position.
Figure 8:
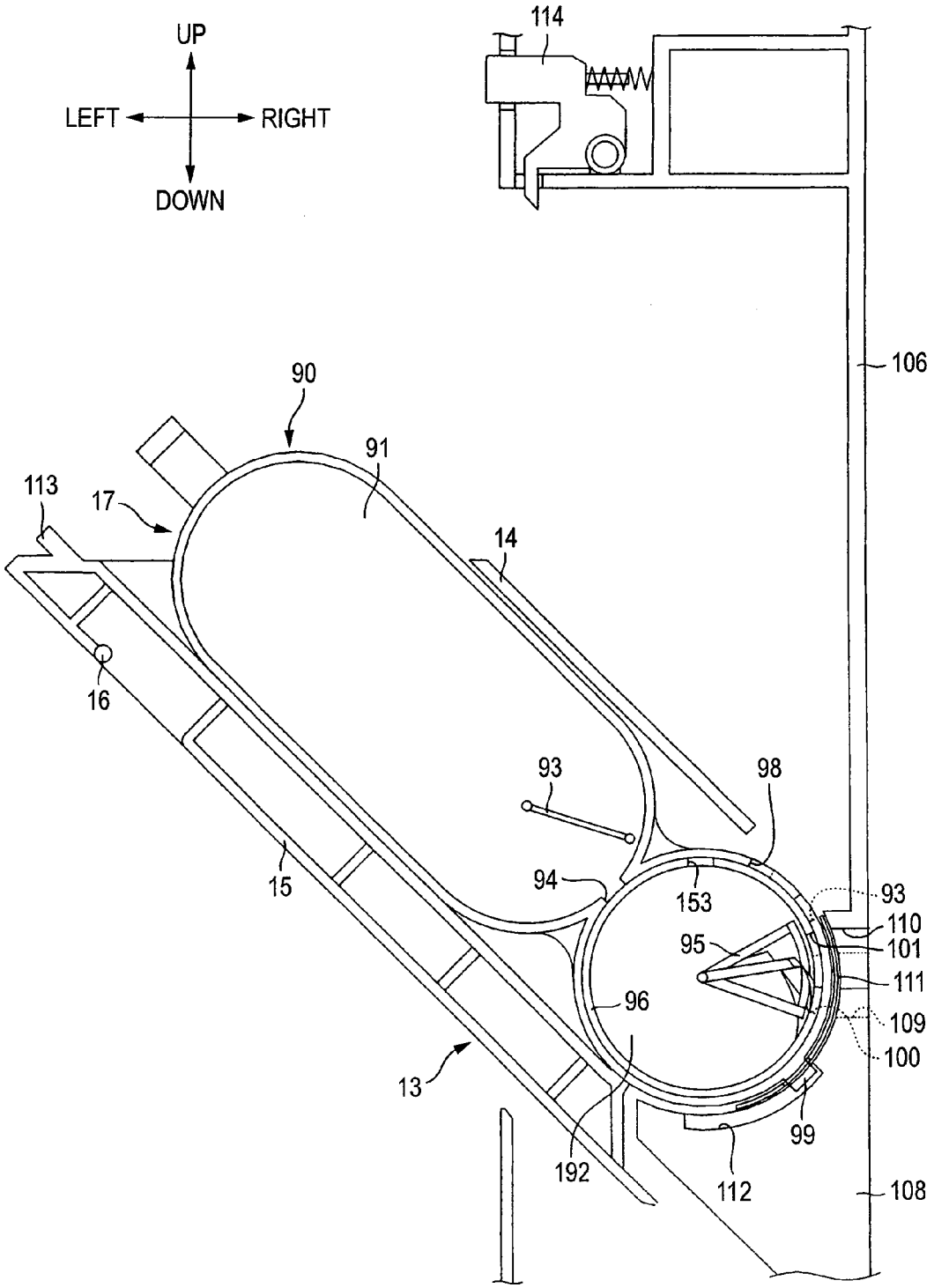
FIG. 8 is a front sectional view of the cartridge holder of the image forming apparatus of FIG. 1 with the holder frame in the attachment and detachment position.

FIG. 6 is a right sectional view of a toner cartridge of the image forming apparatus of FIG. 1. FIG. 7 is a front sectional view of a cartridge holder of the image forming apparatus of FIG. 1 in which the holder frame is in a reception position. FIG. 8 is a front sectional view of a cartridge holder of the image forming apparatus of FIG. 1 in which the holder frame is in the attachment and detachment position.

As shown in FIGS. 6 and 7, the developing unit 51 includes a toner cartridge 90 as an example of the developer cartridge that is detachably attached to the developing casing 60. Four toner cartridges 90 are provided to correspond to four developing units 51.

(c-1) Toner Cartridge

As shown in FIGS. 7 and 8, each of the toner cartridges is detachably received in each of the cartridge receiving portions 17 of the holder frame 14.

As shown in FIG. 6, the toner cartridge 90 has a substantially rectangular, box-like shape when seen from the right side, extending in the up-down direction. As shown in FIG. 7, the toner cartridge 90 integrally includes a toner storing portion 91 disposed at the upper side and a toner supplying portion 92 disposed at the lower side.

The toner storing portion 91 extends in the up-down direction in front sectional view, and the upper and lower ends are curved in a semi-circular arc shape. An upper agitator 93 is provided at the inner lower end of the toner storing portion 91. A nonmagnetic, mono-component, positively-charged toner corresponding to each color, an example of the developer, is stored in the toner storing portion 91.

During image forming operations, the upper agitator 93 rotates when the driving force of the motor is transmitted to an upper agitator gear 104 (see FIG. 6) connected to the rear end of the upper agitator 93.

The toner supplying portion 92 is formed in a substantially circular shape in front sectional view. A communication port 94 is formed between the toner storing portion 91 and the toner supplying portion 92 so that these portions 91 and 92 are communicated with each other in the up-down direction. Within the toner supplying portion 92, a lower agitator 95 and an inner casing 96 are provided.

During image forming operations, the lower agitator 95 rotates when the driving force of the motor is transmitted to a lower agitator gear 105 (see FIG. 6) connected to the rear end of the lower agitator 95.

The inner casing 96 is formed in a cylindrical shape extending along the inner peripheral surface of the toner supplying portion 92 and is rotatably provided to the toner supplying portion 92.

As shown in FIG. 6, an outer return port 97 having a circular shape is formed in the toner supplying portion 92 at the center in the front-rear direction and the up-down direction. An outer conveying port 98 having a circular shape as an example of the supply port is formed at the upper front side of the outer return port 97. In addition, an outer protrusion 99 protruding in a radial direction is formed at the lower end on the front side of the toner supplying portion 92.

As shown in FIG. 7, within the inner casing 96, an inner return port 100 having a circular shape and an inner conveying port 101 having a circular shape are formed in an opposing relationship with the outer return port 97 and the outer conveying port 98, respectively. In addition, a supply port 153 opposed to the communication port 94 is formed in the inner casing 96. As shown in FIG. 6, an inner protrusion 102 protruding in the radial direction is formed at the rear side of the inner casing 96. An elongated hole 103 extending in the circumferential direction is formed in the toner supplying portion 92 at an opposing position to the inner protrusion 102. The inner protrusion 102 is slidably inserted into the elongated hole 103 and protrudes outward in the radial direction of the toner supplying portion 92. The inner casing 96 rotates about the toner supplying portion 92 within a range in which the inner protrusion 102 slides along the elongated hole 103.

(c-2) Partition Plate

As shown in FIGS. 7 and 8, a partition plate 106 is provided in the main casing 2 between the cartridge holder 13 and the process receiving portion 10. The partition plate 106 is formed in a substantially L shape when seen from the front side so that the toner cartridge 90 attached to the holder frame 14 can be received therein. A lock member 114 engaging with an engaging protrusion 113 is provided at the upper end of the partition plate 106.

A receiver portion 108 that receives the toner supplying portion 92 is formed at the lower end of the partition wall 106 at an opposing position to the toner supplying portion 92.

The receiver portion 108 is formed in a circular arc shape that extends along the outer peripheral surface of the toner supplying portion 92 with its thickness gradually increasing from the upper portion to the lower portion and from the partition plate 106 toward the left side. In the receiver portion 108, a body-side return port 109 and a body-side conveying port 110 which pass through the receiver portion 108 in the width direction are formed in an opposing relationship with the outer return port 97 and the outer conveying port 98, respectively.

The return auger 65 and the conveying auger 64 are disposed in an opposing relationship with the body-side return port 109 and the body-side conveying port 110 in the width direction, respectively.

In the top surface of the receiver portion 108, a body-side shutter 111 is provided to correspond to each of the toner cartridges 90. The body-side shutter 111 is provided to the top surface of the receiver portion 108 in a manner slidable in the circumferential direction (up-down direction). The body-side shutter 111 is provided with a through-hole (not shown) through which the outer protrusion 99 passes so that the relative movement of the outer protrusion 99 to the body-side shutter 111 is regulated and a slide hole (not shown) through which the inner protrusion 102 passes so that the relative movement of the inner protrusion 102 to the body-side shutter 111 is allowed.

In the top surface of the receiver portion 108, a slide groove 112 in which the outer protrusion 99 is received so that the relative movement of the outer protrusion 99 and the receiver portion 108 is allowed and a fitting hole (not shown) to which the inner protrusion 102 is fitted so that the relative movement of the inner protrusion 102 to the receiver portion 108 is regulated.

(c-3) Attachment of Toner Cartridge

To attach the toner cartridge 90, as shown in FIGS. 4 and 8, the holder frame 14 is first moved to the attachment and detachment position and then the toner cartridge 90 is attached to the corresponding cartridge receiving portion 17.

At this time, in the toner cartridge 90, the outer protrusion 99 and the inner protrusion 102 overlap with each other in the front-rear direction, the inner return port 100 and the inner conveying port 101 are below the outer return port 97 and the outer conveying port 98, and the outer return port 97 and the outer conveying port 98 are closed by the inner casing 96.

Moreover, the body-side return port 109 and the body-side conveying port 110 are closed by the body-side shutter 111.

When the toner cartridge 90 is attached to the toner cartridge receiving portion 17, the outer protrusion 99 is passed through the through-hole of the body-side shutter 111 and is received in the slide groove 112, and the inner protrusion 102 is passed through the slide hole and is fitted to the fitting hole.

Next, as shown in FIG. 7, the holder frame 14 is pivoted and moved from the attachment and detachment position to the reception position. During the period in which the holder frame 14 is pivoted from the attachment and detachment position to the reception position, the pivoting operation of the inner protrusion 102 is regulated by the fitting hole. In such a state, the outer protrusion 99 is allowed to move along the slide groove 112 so that the outer protrusion 99 is pivoted in the right-to-left direction along the slide groove 112 so as to be moved away from the inner protrusion 102. Thus, the inner casing 96 is slid in the counter-clockwise direction relative to the toner supplying portion 92 when seen from the front side, and the inner return port 100 and the inner conveying port 101 at the reception position are opposed to the outer return port and the outer conveying port 98. In addition, the communication port 94 is opposed to the supply port 153. At the same time, with the pivoting operation of the outer protrusion 99, the body-side shutter 111 is slide downward, and the body-side return port 109 and the body-side conveying port 110 are opposed to the outer return port 97 and the outer conveying port 98.

When the holder frame 14 is moved to the reception position, the engaging protrusion 113 engages with the lock member 114 and the holder frame 14 is locked to the reception position. Thus, the toner cartridge 90 is attached to the developing casing 60.

When the toner cartridge 90 is attached to the developing casing 60, the inner return port 100 and the inner conveying port 101 are disposed to communicate and overlap with the body-side return port 109 and the body-side conveying port 110 in the width direction via the outer return port 97 and the outer conveying port 98, respectively. In addition, the inner return port 100 and the inner conveying port 101 are disposed to overlap with the return auger 65 and the conveying auger 64, respectively, in the width direction (horizontal direction).

The toner cartridge 90 is attached to and detached from the developing casing 60 from the left ends in the axial direction of the return auger 65 and the conveying auger 64.

(c-4) Detachment of Toner Cartridge

To detach the toner cartridge 90, the lock state of the lock member 114 to the engaging protrusion 113 is first released and then, as shown in FIGS. 4 and 8, the holder frame 14 is moved from the reception position to the attachment and detachment position.

Then, during a period in which the holder frame 14 is pivoted from the reception position to the attachment and detachment position, the pivoting operation of the inner protrusion 102 is regulated by the fitting hole. In such a state, the outer protrusion 99 is allowed to move along the slide groove 112 so that the outer protrusion 99 is pivoted in the left-to-right direction along the slide groove 112 so as to be moved toward the inner protrusion 102. Thus, the inner casing 96 is slid in the clockwise direction relative to the toner supplying portion 92 when seen from the front side, and the outer return port 97 and the outer conveying port 98 at the attachment and detachment position are closed by the inner casing 96. In addition, the communication port 94 is closed by the inner casing 96. At the same time, with the pivoting operation of the outer protrusion 99, the body-side shutter 111 is slid upward, and the body-side return port 109 and the body-side conveying port 110 are closed by the body-side shutter 111. Thus, the toner cartridge 90 is detached from the developing casing 60.

Thereafter, the toner cartridge 90 is detached from the cartridge receiving portion 17.

(d) Developing Process in Process Unit

When the toner cartridge 90 is attached to the developing casing 60, as shown in FIG. 7, a toner stored in the toner storing portion 91 in the cartridge 90 falls by its own weight while being stirred by the upper agitator 93 and is supplied to the toner supplying portion 92 via the communication port 94 and the supply port 153.

The toner stored in the toner supplying portion 92 is supplied to the conveying auger 64 via the inner conveying port 101, the outer conveying port 98, and the body-side conveying port 110 by the stirring of the lower agitator 95.

As shown in FIG. 5, the toner supplied to the conveying auger 64 is conveyed by the rotating conveying screw 81 from the left end to the right end within the developing chamber 68 along the axial direction of the conveying auger 64. The toner is supplied to the supply roller 63 while being conveyed, and the toner that was not supplied to the supply roller 63 is returned to the return auger 65 via the communication port 152 in the partition wall 67.

The toner returned to the return auger 65 is conveyed by the rotating return screw 85 from the right end to the left end within the developing chamber 68 along the axial direction of the return auger 65. Thereafter, the toner is returned to the toner supplying portion 92 via the body-side return port 109, the outer return port 97, and the inner return port 100. Thus, the toner circulates between the toner cartridge 90 and the developing casing 60.

As shown in FIG. 2, the toner supplied to the supply roller 63 is supplied to the developing roller 61 by the rotation of the supply roller 63. At this time, the toner is positively charged by friction while being passed between the sponge roller 76 and the rubber roller 72. Thereafter, the toner is moved between the pressure-contact portion 74 and the rubber roller 72 with the rotation of the developing roller 61 and formed as a thin layer having a predetermined thickness. Accordingly, the toner is carried on the surface of the rubber roller 72 as a thin layer.

On the other hand, the surface of the drum body 54 is uniformly positively charged by a corona discharge generated from the scorotron charger 49. The positively charged surface is exposed by laser beams emitted from the scanner unit 37 with the rotation of the drum body and input via the input path 53. Accordingly, electrostatic latent images corresponding to the images to be formed on the sheet 3 are formed on the surface of the drum body 54.

When the drum body 54 rotates, the toner carried on the surface of the rubber roller 72 is supplied to the electrostatic latent images formed on the surface of the drum body 54 when contacting the drum body 54 in an opposing relationship with the rotation of the developing roller 61. Thus, the electrostatic latent images on the drum body 54 are developed and toner images corresponding to each color are carried on the surface of the drum body 54.

(4-3) Transfer Unit

As shown in FIG. 1, the transfer unit 40 is disposed above the process receiving portion 10 so as to extend in the front-rear direction. The transfer unit 40 includes a driving roller 116, a driven roller 117, an intermediate transfer belt 118 as an example of the transfer member, a primary transfer roller 119, a secondary transfer roller 120, a relay path 121, and a cleaning unit 122.

The driving roller 116 is disposed at the upper rear side of the photosensitive drum 48 of the black process unit 46K. The driving roller 116 rotates in a direction (clockwise direction in the drawing) opposite to the rotation direction of the photosensitive drum 48 during image forming operations.

The driven roller 117 is disposed at the upper front side of the photosensitive drum 48 of the yellow process unit 46Y in an overlapping manner with the driving roller 116 in the front-rear direction. When the driving roller 116 rotates, the driven roller 117 is rotated in the same direction (clockwise direction in the drawing) as the rotation direction of the driving roller 116.

The intermediate transfer belt 118 is made of a conductive resin having conductive particles such as carbon scattered thereon and is formed in an endless belt shape. The intermediate transfer belt 118 is wound between the driving roller 116 and the driven roller 117.

Each of the photosensitive drums 48 is exposed upward from a transfer opening 52 (see FIG. 2) and is disposed below the intermediate transfer belt 118. The outer surface of the intermediate transfer belt 118 is disposed in an opposing contact relationship with all the photosensitive drums 48.

The driven roller 117 is driven by the rotation of the driving roller 116, and the intermediate transfer belt 118 circulates in the clockwise direction in the drawing between the driving roller 116 and the driven roller 117.

The primary transfer roller 119 is disposed in the inner space of the wound intermediate transfer belt 118. The primary transfer roller 119 comprises a plurality of the primary transfer rollers 119 each corresponding to one of the photosensitive drums 48 of the process units 46. Each of the primary transfer rollers 119 is disposed above the corresponding photosensitive drum 48 in an opposing relationship with the photosensitive drum 48 with the intermediate transfer belt 118 disposed therebetween.

Each of the primary transfer rollers 119 includes a primary transfer roller shaft made of metallic materials and a rubber roller formed of conductive rubber and covering the primary transfer roller shaft. The primary transfer roller shaft extends in the width direction and is rotatably supported by the main casing 2.

During image forming operations, the primary transfer rollers 119 rotate in the same direction (clockwise direction in the drawing) as the circulation direction of the intermediate transfer belt 118 at a position (primary transfer position) at which the primary transfer rollers 119 contact the intermediate transfer belt 118). The primary transfer rollers 119 are applied with a primary transfer bias during image forming operations.

The secondary transfer roller 120 is disposed at the rear side of the driving roller 116 so that the intermediate transfer belt 118 is sandwiched between the driving roller 116 and the secondary transfer roller 120. The secondary transfer roller 120 includes a secondary transfer roller shaft made of metallic material and a rubber roller formed of conductive rubber and covering the secondary transfer roller shaft. The secondary transfer roller shaft extends in the width direction and is rotatably supported by the main casing 2.

During image forming operations, the secondary transfer roller 120 rotates in a direction (counter-clockwise direction in the drawing) opposite to the circulation direction of the intermediate transfer belt 118 at a position (secondary transfer position) at which the secondary transfer roller 120 contacts the intermediate transfer belt 118). The secondary transfer roller 120 is applied with a secondary transfer bias during image forming operations.

The relay path 121 is formed to extend slightly upward from the secondary transfer position toward the fixing portion 41.

The circulating intermediate transfer belt 118 sequentially passes through the contact positions (primary transfer position) of the photosensitive drums and the process units 46 in the front-to-rear direction. Toner images carried on the photosensitive drums 48 corresponding to each color are sequentially transferred to the intermediate transfer belt 118 by the primary transfer bias applied to the primary transfer rollers 119 during a period in which the intermediate transfer belt 118 passes through the photosensitive drums 48. Accordingly, color images are formed on the intermediate transfer belt 118.

Specifically, yellow toner images carried on the surface of the photosensitive drum 48 of the yellow process unit 46Y are transferred to the intermediate transfer belt 118 and thereafter, magenta toner images carried on the surface of the photosensitive drum 48 of the magenta process unit 46M are overlapped and transferred to the intermediate transfer belt 118 having the yellow toner images formed thereon.

By repeating the same operations, cyan toner images carried on the surface of the photosensitive drum 48 of the cyan process unit 46C and black toner images carried on the surface of the photosensitive drum 48 of the black process unit 46K are overlapped and transferred to the intermediate transfer belt 118. Accordingly, color images are formed on the intermediate transfer belt 118.

The color images formed on the intermediate transfer belt 118 are entirely transferred by the secondary transfer bias applied to the secondary transfer roller 120, onto the sheet 3 conveyed from the sheet feeding portion 4 to the secondary transfer position during a period in which the intermediate transfer belt 118 passes through the contact position (secondary transfer position) with the secondary transfer roller 120. The sheet 3 having the color images transferred thereto is conveyed to the fixing portion 41 along the relay path 121.

The cleaning unit 122 is disposed above the intermediate transfer belt 118 and includes a primary cleaning roller 123, a secondary cleaning roller 124, a scraping blade 125, and a storing portion 126.

In the cleaning unit 122, the toner adhering onto the surface of the intermediate transfer belt 118 during the above-described transfer process is first transferred from the surface of the intermediate transfer belt 118 to the primary cleaning roller 123. Thereafter, the toner is transferred to the secondary cleaning roller 124. Then, the toner is scraped by the scraping blade 125 and falls off from the secondary cleaning roller 124 to be stored in the storing portion 126.

(4-4) Fixing Portion

The fixing portion 41 is disposed above the secondary transfer position, and includes a heating roller 129 and a pressing roller 130 disposed opposite the heating roller 129 and pressing the heating roller 129. In the fixing portion 41, the color images transferred onto the sheet 3 are thermally fixed onto the sheet 3 by heat and pressure during a period in which the sheet 3 is passed between the heating roller 129 and the pressing roller 130.

(5) Sheet Discharging Portion

The sheet discharging portion 6 includes a pair of conveying rollers 131, a sheet discharging path 132, a discharge roller 133, and a sheet discharging tray 134.

The pair of conveying rollers 131 is disposed at the upper front side of the fixing portion 41 in a mutually contacting relationship.

The sheet discharging path 132 is formed to extend forward from the contact position of the pair of conveying rollers 131.

The discharge roller 133 comprises three rollers in which two rollers are in contact with a remaining one roller. The discharge rollers 133 are disposed at the front side of the sheet discharging path 132 so that one of the rollers is exposed into the in-chassis sheet discharging portion 9.

The sheet discharging tray 134 is formed as the top wall of the main casing 2 in the in-chassis sheet discharging portion 9. The sheet discharging tray 134 is formed such that it gradually deepens from the front side to the rear side.

In the sheet discharging portion 6, the thermally fixed sheet 3 is conveyed by the conveying rollers 131 along the sheet discharging path 132 and is discharged onto the sheet discharging tray 134 by the discharge roller 133.

2. Effects of Exemplary Embodiment (1) In the developing unit 51, as shown in FIG. 2, the developing casing 60 is disposed such that the developing opening 66 faces upward, and the upper portion of the developing roller 61 is exposed from the developing opening 66. The thickness regulating blade is disposed below the developing roller 61, and the supply roller 63 is disposed at the lower front side of the developing roller 61 and at the upper front side of the conveying auger 64. In addition, the supply roller is disposed such that in the horizontal direction, the upper portion of the supply roller 63 overlaps with the lower portion of the developing roller 61 and that the lower portion of the supply roller 63 overlaps with the upper portion of the conveying auger 64.

Thus, within the developing chamber 68, the toner is first conveyed by the conveying roller 64 to the supply roller 63 disposed on the front side of the conveying auger 64. Thereafter, the toner is supplied from the supply roller 63 to the developing roller 61 disposed above the supply roller 63. The toner is carried as a thin layer on the surface of the developing roller 61 according to the regulation of the thickness regulating blade 62. The toner carried on the surface of the developing roller 61 is used in developing processes when opposed to the photosensitive drum 48 via the developing opening 66.

The toner that was not supplied from the supply roller 63 to the developing roller 61 and the toner that was removed by the thickness regulating blade 62 from the surface of the developing roller 61 fall off of the developing roller 61.

Meanwhile, the conveying auger 64 is disposed within the projection plane (shown by the dotted line 87) in the up-down direction (vertical direction) between the pressure-contact position 78 of the pressure-contact portion 74 to the rubber roller 72 and the contact position 79 of the sponge roller 76 to the rubber roller 72. Thus, any toner falling off from the developing roller 61 is again conveyed by the conveying auger 64 to the supply roller 63 and thereafter is used in developing processes.

As a result, the developing roller 61 can efficiently carry a sufficient amount of a toner. Since the toner that is not carried on the surface of the developing roller 61 falls down in the inner front portion of the developing chamber 68 that is partitioned as a closed space, it is possible to prevent leakage of the toner from the developing unit 51. Even when the toner leaks between the thickness regulating blade 62 and the developing roller 61 outside the inner front portion of the developing chamber 68 that is partitioned as the closed space, the toner falls down onto the thickness regulating blade 62 on the partition wall 67 without facing toward the developing opening 66. For this reason, it is possible to efficiently prevent leakage of the toner from the developing casing 60.

The thickness regulating blade 62 and the conveying auger 64 are disposed below the developing roller 61. The supply roller 63 is disposed at the front side of the thickness regulating blade 62 and the conveying auger 64. The tangential line 77 extending in the vertical direction at the rearmost end of the supply roller 63 passes through the front portion of the developing roller 61 and the front most end of the conveying auger 64. Thus, it is possible to decrease the horizontal length of the developing unit 51. Accordingly, it is possible to enable miniaturization of the developing unit 51 and to thus decrease the horizontal size of the color laser printer 1.

Since the toner is conveyed by the conveying auger 64 from the left end to the right end within the developing chamber 68 along the axial direction of the conveying auger 64, the toner can circulate appropriately, i.e., the toner can circulate in a convective manner. As a result, it is possible to supply the toner from the conveying auger 64 to the developing roller 61 via the supply roller 63.

(2) In the developing unit 51, when the toner cartridge is attached to the developing casing 60, the inner return port 100 and the inner conveying port 101 are disposed to communicate and overlap with the body-side return port 109 and the body-side conveying port 110 in the width direction via the outer return port 97 and the outer conveying port 98, respectively. In addition, the inner return port 100 and the inner conveying port 101 are disposed to overlap with the return auger 65 and the conveying auger 64, respectively, in the width direction (horizontal direction).

Thus, it is possible to smoothly supply the toner in the toner cartridge 90 to the conveying auger 64 via the inner conveying port 101, the outer conveying port 98, and the body-side conveying port 110. In addition, it is possible to smoothly return the toner returned by the return auger 65 to the toner cartridge 90 via the body-side return port 109, the outside return port 97, and the inner return port 100.

As a result, it is possible to smoothly circulate the toner between the toner cartridge 90 and the developing casing 60.

(3) The toner cartridge 90 is attached to and detached from the developing casing 60 from the left end in the axial direction of the conveying auger 64. Thus, the toner is supplied from the toner cartridge 90 to the left end in the axial direction of the conveying auger 64. The toner supplied to the conveying auger 64 is conveyed by the conveying auger 64 from the left end to the right end. As a result, it is possible to supply the toner from the conveying auger 64 in a substantially uniform manner in the axial direction of the supply roller 63.

(4) The toner supplied from the conveying auger 64 to the supply roller 63 can be securely supplied by the supply roller 63 to the developing roller 61.

(5) The developing roller 61 rotates such that a pressure-contact position 78 of the thickness regulating blade 62 to the developing roller 61 is on the upstream side of the exposure position of the developing roller from the developing opening 66 and that a contact position 79 of the supply roller 63 to the developing roller 61 is on the downstream side of the exposure position.

The intersection 88 of the surface of the rubber roller and the segment 87 that connects the central axis line of the developing roller shaft 71 and the central axis line of the conveying auger shaft 80 is on the downstream side of the contact position 79 in the rotation direction of the developing roller 61. The pressure-contact position 78 is on the downstream side of the intersection 88 in the rotation direction of the developing roller 61.

Thus, at the contact position 79, the toner is supplied from the supply roller 63 to the developing roller 61 and passed through the intersection 88, and thereafter, at the pressure-contact position 78, is carried as a thin layer on the surface of the developing roller 61 with the thickness regulating blade 62. Although the toner that is removed from the surface of the developing roller 61 by the thickness regulating blade 62 falls off from the developing roller 61, since the intersection 88 is on the upstream side of the pressure-contact position 78, the toner falls down onto the upper portion of the conveying auger 64. Accordingly, the toner can be securely supplied again to the developing roller 61, and the toner can circulate efficiently.

(6) The color laser printer 1 includes the above-described developing unit 51. Thus, it is possible to prevent leakage of the toner from the developing unit 51 into the main casing 2. Even when the toner leaks between the thickness regulating blade 62 and the developing roller 61, the toner falls down without facing toward the developing opening 66 and it is thus possible to prevent the toner from adhering onto the photosensitive drum 48. Therefore, it is possible to prevent improper developing. Since the horizontal length of the developing unit 51 can be decreased, even when the developing units 51 are arranged in parallel in the horizontal direction, it is possible to enable miniaturization of the main casing 2. Accordingly, a horizontal tandem-type color laser printer 1 in which a plurality of photosensitive drums 48 are arranged in parallel has a small size.

(7) In the color laser printer 1, the developing roller 61 is disposed below the photosensitive drum 48. Thus, it is possible to securely develop electrostatic latent images formed on the photosensitive drum 48 with the developing roller 61 while preventing the toner leaking from the inner front portion of the developing chamber 68 that is partitioned as a closed space from adhering onto the photosensitive drum 48.

(8) In the color laser printer 1, the photosensitive drums 48 are disposed below the intermediate transfer belt 118. Therefore, it is possible to securely transfer the toner images from the photosensitive drums 48 to the intermediate transfer belt 118 while enabling miniaturization of the main casing 2.

3. Additional Exemplary Embodiments of the Present Invention

(1) First Modification

Figure 9:
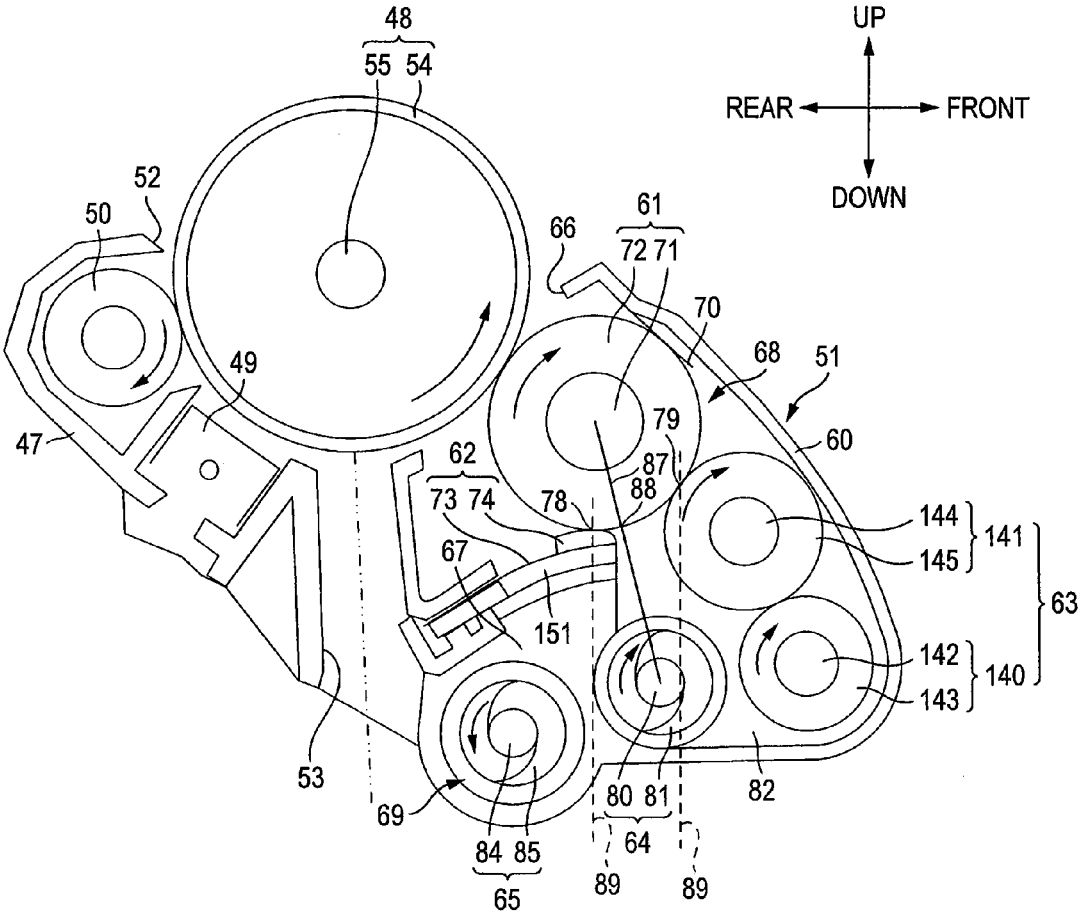
FIG. 9 is an enlarged sectional view illustrating a part of a process unit according to another exemplary embodiment of the present invention.

FIG. 9 is an enlarged sectional view illustrating a part of an image forming apparatus according to another exemplary embodiment of the present invention.

Although the developing unit 51 according to the exemplary embodiment described above includes one supply roller 63, it is also possible to provide a developing unit having, for example, two supply rollers 63 as shown in FIG. 9.

In FIG. 9, in the developing unit 51, the supply roller comprises a first supply roller 140 and a second supply roller 141. In FIG. 9, the same components as those shown in FIG. 2 will be denoted by the same reference numerals, and descriptions thereof will be omitted. In FIG. 9, the developing casing 60 is integrally formed with the process casing 47.

The second supply roller 141 is disposed at the lower front side of the developing roller 61 and at the upper front side of the conveying auger 64, in the inner front portion of the developing chamber 68. Specifically, the second supply roller 141 is disposed such that in the front-rear direction (horizontal direction), the upper portion of the second supply roller 141 overlaps with the lower portion of the developing roller 61 and that the lower portion of the second supply roller 141 overlaps with the upper portion of the conveying auger 64. In addition, the second supply roller 141 is disposed such that in the up-down (vertical direction), the rear portion of the second supply roller 141 overlaps with the front portion of the developing roller 61 and the front portion of the conveying auger 64.

The second supply roller 141 is in contact with the developing roller 61.

The first supply roller 140 is disposed at the lower front portion of the second supply roller 141 and at the front side of the conveying auger 64, in the inner front portion of the developing chamber 68. Specifically, the first supply roller 140 is disposed such that, in the front-rear direction (horizontal direction), the uppermost end of the first supply roller 140 overlaps with the lowermost end of the second supply roller 141 and such that portions of the first supply roller 140 other than the upper portion overlap with the conveying auger 64. In addition, the first supply roller 140 is disposed such that in the up-down direction (vertical direction), the rear portion of the first supply roller 140 overlaps with the front portion of the second supply roller 141.

The first supply roller 140 is in contact with the second supply roller 141.

The first supply roller 140 includes a first supply roller shaft 142 and a first sponge roller 143 that covers the first supply roller shaft 142. The second supply roller 141 includes a second supply roller shaft 144 and a second sponge roller 145 that covers the second supply roller shaft 144. The first and second supply rollers 142 and 144 are rotatably supported by both side walls 82 of the developing casing 60 and rotate in the clockwise direction when seen from the left side by the driving force of the motor during image forming operations.

In FIG. 9, the conveying auger 64 is disposed below the developing roller 61 and at the lower rear side of the second supply roller 141, in the inner front portion of the developing chamber 68. Specifically, the rear portion of the conveying auger 64 is disposed within a projection plane (shown by the dotted line 89) in the up-down direction (vertical direction) between the pressure-contact position 78 of the pressure-contact portion 74 to the rubber roller 72 and the contact position 79 of the second sponge roller 145 to the rubber roller 72.

Specifically, the intersection 88 of the surface of the rubber roller 72 and the segment 87 that connects the central axis line of the developing roller shaft 71 and the central axis line of the conveying auger shaft 80 is on the downstream side of the contact position 79 in the rotation direction of the developing roller 61. In addition, the pressure-contact position 78 is on the downstream side of the intersection in the rotation direction of the developing roller 61.

The conveying auger 64 is disposed at a distance from the developing roller 61, the first supply roller 140, and the second supply roller 141.

Within the developing chamber 68, the toner is first conveyed by the conveying roller 64 to the first supply roller 140 disposed on the front side of the conveying auger 64. Thereafter, the toner is supplied from the first supply roller 140 to the second supply roller 141 disposed above the first supply roller 140. The toner is then supplied from the second supply roller 141 to the developing roller 61 disposed above the second supply roller 141. The toner is carried as a thin layer on the surface of the developing roller 61 according to the regulation of the thickness regulating blade 62. The toner carried on the surface of the developing roller 61 is used in developing processes when opposed to the photosensitive drum 48 via the developing opening 66.

The toner that was not supplied from the first supply roller 140 to the second supply roller 141, the toner that was not supplied from the second supply roller 141 to the developing roller 61, and the toner that was removed by the thickness regulating blade 62 from the surface of the developing roller 61 fall off from the developing roller 61.

Meanwhile, the rear portion of the conveying auger 64 is disposed within the projection plane (shown by the dotted line 89) in the up-down direction (vertical direction) between the pressure-contact position 78 of the pressure-contact portion 74 to the rubber roller 72 and the contact position 79 of the second sponge roller 145 to the rubber roller 72. Thus, the toner falling off from the developing roller 61 is again conveyed by the conveying auger 64 to the first supply roller 140 and thereafter is used in developing processes.

As a result, the developing roller 61 can efficiently carry a sufficient amount of a toner.

At the contact position 79, the toner is supplied from the second supply roller 141 to the developing roller 61 and passed through the intersection 88, and thereafter, at the pressure-contact position 78, is carried as a thin layer on the surface of the developing roller 61 with the thickness regulating blade 62. Although the toner that is removed from the surface of the developing roller 61 by the thickness regulating blade 62 falls off from the developing roller 61, since the intersection 88 is on the upstream side of the pressure-contact position 78, the toner falls down onto the upper portion of the conveying auger 64. Therefore, the toner can be securely supplied again to the developing roller 61, and the toner can circulate efficiently.

In FIG. 9, the toner is conveyed from the conveying auger 64 to the first supply roller 140 and from the first supply roller 140 to the second supply roller 141, and thereafter is supplied from the second supply roller 141 to the developing roller 61. Thus, it is possible to stably supply the toner from the conveying auger 64 to the developing roller 61.

In FIG. 9, the toner is conveyed from the conveying auger 64 to the first supply roller 140 disposed at the front side and supplied from the first supply roller 140 to the second supply roller 141 disposed above the first supply roller 140, and thereafter, is supplied from the second supply roller 141 to the developing roller 61 disposed above the second supply roller 141. Thus, it is possible to efficiently supply the toner from the auger 64 to the developing roller 61.

(2) Second Modification

In the exemplary embodiments of the present invention described above, although the process unit 46 includes the developing unit 51, the process unit 46 and the developing unit 51 may be integrated with each other. In this case, the photosensitive drum 48, the scorotron charger 49, the cleaning roller 50, the developing roller 61, the thickness regulating blade 62, the supply roller 63, the conveying auger 64, and the return auger 65 are installed in a single chassis (e.g., the process casing 47), and the process unit 46 corresponds to the developing device according to an exemplary embodiment of the present invention.

(3) Third Modification

In the exemplary embodiments described above, the process unit 46 includes the developing unit 51. However, according to another exemplary embodiment of the present invention, the photosensitive drum 48, the scorotron charger 49, and the cleaning roller 50 may be installed in the main casing 2 so that the developing unit 51 can be detachably attached to the main casing 2.

(4) Fourth Modification

In the above-described exemplary embodiments, an intermediate transfer, tandem-type color laser printer 1 was illustrated. However, the present inventive concept also applies to an image forming apparatus of a direct, tandem-type color laser printer or a monochromatic laser printer.

As described above, according to exemplary embodiments of the present invention, at least a portion of the supply port of the developer cartridge overlaps with a portion of the conveying member in the horizontal direction. Thus, it is possible to smoothly supply the developer in the developer cartridge to the conveying member via the supply port.

According to exemplary embodiments of the present invention, the developer cartridge is attached to and detached from the chassis from one end in the longitudinal direction of the conveying member. Accordingly, the developer is supplied from the developer cartridge to the one end in the longitudinal direction of the conveying member. The developer supplied to the conveying member is conveyed by the conveying member from the one end in the longitudinal direction toward the other end. As a result, it is possible to supply the developer from the conveying member in a substantially uniform manner in the longitudinal direction of the supply member.

According to exemplary embodiments of the present invention, the supply member is a supply roller. Thus, it is possible to securely supply the developer conveyed from the conveying member to the developer carrying member.

According to exemplary embodiments of the present invention, the developer is conveyed from the conveying member to the first supply roller and then from the first supply roller to the second supply roller, and is finally supplied from the second supply roller to the developer carrying member. Thus, it is possible to stably supply the developer from the conveying member to the developer carrying member.

According to exemplary embodiments of the present invention, the developer is conveyed from the conveying member to the first supply roller disposed on the lateral side and then from the first supply roller to the second supply roller disposed above the first supply roller, and is finally supplied from the second supply roller to the developer carrying member disposed above the second supply roller. Thus, it is possible to efficiently supply the developer from the conveying member to the developer carrying member.

According to exemplary embodiments of the present invention, the contact position, the intersecting portion of an outer peripheral surface of the developer carrying member and a segment that connects a central axis line of the developer carrying member and a central axis line of the conveying member, and the pressure-contact position are sequentially arranged in this order from the upstream side to the downstream side in the rotation direction of the developer carrying member. Accordingly, the developer is supplied from the supply member to the developer carrying member at the contact position, and after passing through the intersection, is carried as a thin layer on the surface of the developer carrying member with the thickness regulating member at the pressure-contact position. The developer that was removed by the thickness regulating member from the surface of the developer carrying member falls off from the developer carrying member. However, since the intersecting portion is on the upstream side of the pressure-contact position, it is possible for the developer to fall down onto the upper portion of the conveying member. Thus, the developer can be securely supplied again to the developer carrying member, and the developer can circulate efficiently.

According to exemplary embodiments of the present invention, the image forming apparatus includes the above described developing device. Thus, it is possible to prevent leakage of the developer from the developing device into the main body. Even when the developer leaks between the thickness regulating member and the developer carrying member, the developer falls down without facing toward the opening and it is thus possible to prevent the developer from adhering onto the photosensitive member. Therefore, it is possible to prevent improper developing. Since the horizontal length of the developing device can be decreased, even when the developing devices are arranged in parallel in the horizontal direction, it is possible to enable miniaturization of the main body. Thus, a horizontal tandem-type color laser printer in which a plurality of photosensitive members is arranged in parallel can be designed to have a small size.

According to exemplary embodiments of the present invention, the developer carrying member is disposed below the photosensitive member. Accordingly, it is possible to securely develop electrostatic latent images formed on the photosensitive member with the developer carrying member while preventing the developer leaking from the developing device from adhering onto the photosensitive member.

According to exemplary embodiments of the present invention, the photosensitive members are disposed below the transfer member. Therefore, it is possible to securely transfer the developer images from the photosensitive members to the transfer member while enabling miniaturization of the main body.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A developing device detachably attachable to a main body of an image forming apparatus, the developing device comprising:

a developer carrying member configured to rotate and carry developer;

a thickness regulating member configured to contact the developer carrying member and regulate a thickness of developer on the developer carrying member;

a supply member configured to:

contact the developer carrying member;

rotate; and carry developer to the developer carrying member; and a first developer moving member configured to rotate and move developer, wherein, when the developing device is attached to the main body of the image forming apparatus, the developer carrying member at least partially overlaps with the supply member viewed in a horizontal direction and the first developer moving member at least partially overlaps with the supply member viewed in a horizontal direction.

2. The developing device according to claim 1, wherein the first developer moving member at least partially overlaps with the developer carrying member viewed in a vertical direction.

3. The developing device according to claim 2, wherein the first developer moving member entirely overlaps with the developer carrying member viewed in the vertical direction.

4. The developing device according to claim 1, wherein the first developer moving member moves the developer along a first direction parallel to a rotating axis thereof.

5. The developing device according to claim 1, wherein the first developer moving member is disposed between a first contact portion in which the thickness regulating member contacts the developer carrying member and a second contact portion in which the supply member contacts the developer carrying member.

6. The developing device according to claim 1, wherein a rotating axis of the supply member, a rotating axis of the first developer moving member, and a rotating axis of the developer carrying member are arranged in this order from a front side to a rear side in the horizontal direction.

7. The developing device according to claim 1, wherein a rotating axis of the developer carrying member, a rotating axis of the supply member, and a rotating axis of the first developer moving member are arranged in this order from an upper side to a lower side in a vertical direction.

8. The developing device according to claim 1, further comprising:

a second developer moving member configured to rotate and move developer, wherein a position of a rotating axis of the second developer moving member is lower than a position of a rotating axis of the first developer moving member.

9. The developing device according to claim 1, further comprising a casing, wherein the developer carrying member, the supply member, and the developer moving member are disposed inside the casing.

10. The developing device according to claim 1, wherein the first developer moving member does not overlap with the developer carrying member viewed in the horizontal direction.

11. The developer device according to claim 1, wherein the first developer moving member includes an auger.

* * * * *